US006579388B2

(12) United States Patent
Pike, Jr. et al.

(10) Patent No.: US 6,579,388 B2
(45) **Date of Patent: *Jun. 17, 2003**

(54) AGING TREATMENT FOR NI-CR-MO ALLOYS

(75) Inventors: Lee M. Pike, Jr., Kokomo, IN (US); Dwaine L. Klarstrom, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 33 days.

This patent is subject to a terminal disclaimer.

(21) Appl. No.: 09/894,353

(22) Filed: Jun. 28, 2001

(65) Prior Publication Data

US 2003/0070733 A1 Apr. 17, 2003

(51) Int. Cl.[7] ..... C22F 1/10; C22C 19/05
(52) U.S. Cl. ..... 148/675
(58) Field of Search ..... 148/675, 428; 420/448

(56) References Cited

U.S. PATENT DOCUMENTS

| | | | | | |
|---|---|---|---|---|---|
| 3,871,928 | A | | 3/1975 | Smith, Jr. et al. | |
| 4,006,012 | A | | 2/1977 | Kindlimann | |
| 4,080,201 | A | * | 3/1978 | Hodge et al. | 420/446 |
| 4,118,223 | A | | 10/1978 | Acuncius et al. | |
| 4,129,464 | A | | 12/1978 | Matthews et al. | |
| 4,245,698 | A | * | 1/1981 | Berkowitz et al. | 148/677 |
| 4,818,486 | A | | 4/1989 | Rothman et al. | |
| 4,906,437 | A | | 3/1990 | Heubner et al. | |
| 5,019,184 | A | | 5/1991 | Crum et al. | |

FOREIGN PATENT DOCUMENTS

| | | | | | |
|---|---|---|---|---|---|
| EP | 0 499 969 A1 | | 2/1992 | | |
| GB | 2 003 179 A | | 8/1987 | | |
| JP | 52-120913 A | * | 10/1977 | | C22C/19/05 |
| JP | 59-025941 A | * | 2/1984 | | C22C/19/05 |
| JP | 60-187652 A | * | 9/1985 | | C22C/19/05 |
| JP | 61284558 A | | 12/1986 | | |
| JP | 63162845 A | | 7/1988 | | |
| JP | 3257131 A | | 11/1991 | | |
| JP | 05-255788 A | * | 10/1993 | | C22C/19/05 |
| JP | 07-003369 A | * | 1/1995 | | C22C/19/05 |
| JP | 8067940 A | | 3/1996 | | |
| WO | 98/55661 | | 12/1998 | | |
| WO | WO 00/03053 | | 1/2000 | | |

OTHER PUBLICATIONS

"Advanced Microcharacterization of Nickel–Based Superalloys," I.M. Anderson, M. K. Miller, L. M. Pike and D. L. Klarstrom, Oak Ridge National Laboratory, CRADA Final Report, Feb. 2000.

"New Materials and Processing to Enhance Affordability," D. L. Klarstrom, Advanced Technologies for Superalloy Affordability, Symposium sponsored by the Structural Materials Division of The Minerals, Metals & Materials Society (TMS), 2000 TMS Annual Meeting, Nashville, Tennessee, Mar. 12–16, 2000.

* cited by examiner

*Primary Examiner*—Roy King
*Assistant Examiner*—Harry D. Wilkins, III
(74) *Attorney, Agent, or Firm*—Buchanan Ingersoll, P.C.

(57) ABSTRACT

A single step heat treatment for Ni-Cr-Mo alloys containing from 12% to 19% chromium and from 18% to 23% molybdenum provides higher yield strength, high tensile strength and other mechanical properties comparable to those observed in similar alloys age-hardened according to current practices. This treatment is done over a total time of at least 24 hours and preferably less than 50 hours. However, the treatment works for only those alloys having alloying elements present in amounts according to an equation here disclosed.

4 Claims, 2 Drawing Sheets

$$P = 2.64\,Al + 0.19\,Co + 0.83\,Cr - 0.16\,Cu + 0.39\,Fe + 0.59\,Mn + 1.0\,Mo + 0.81\,Zr + 2.15\,Si + 1.06\,V + 0.39\,W + 0.68\,Nb + 0.52\,Hf + 0.45\,Ta + 1.35\,Ti$$

Box Limits: $12 < Cr < 19$ and $31.2 < P < 35.9$ $$P = 2.64\,Al + 0.19\,Co + 0.83\,Cr - 0.16\,Cu + 0.39\,Fe + 0.59\,Mn + 1.0\,Mo + 0.81\,Zr + 2.15\,Si + 1.06\,V + 0.39\,W + 0.68\,Nb + 0.52\,Hf + 0.45\,Ta + 1.35\,Ti$$

Box Limits: $18 < Mo < 23$ and $31.2 < P < 35.9$

AGING TREATMENT FOR NI-CR-MO ALLOYS

FIELD OF THE INVENTION

The invention relates to heat treatment processes for nickel-chromium molybdenum-alloys having a chromium content of from 12 to 19 weight per cent.

BACKGROUND OF THE INVENTION

It is well-known that chromium imparts corrosion resistance to nickel base alloys. Therefore, Ni—Cr—Mo alloys and particularly those with chromium content of 15 to 24% have been popular for use in corrosive environments such as encountered in the chemical and petrochemical industries.

Age-hardening is a process used in the metallurgical industry to give an alloy composition higher strength, as measured by its yield strength, tensile strength, and by notched stress rupture tests typically used in the art. Various applications demand a combination of high tensile strength and low thermal expansion properties. One such application is in the aerospace industry. Another application is seal rings used in land-based gas turbines. A combination of high tensile strength and ductility is also very useful for bolts. Because of the demanding operating conditions and performance parameters for metal products in these applications, various methods of age-hardening have been used. One common technique is to heat the alloy to a selected high temperature, hold the alloy at that temperature for a period of time and then cool the alloy to room temperature. For some alloy compositions, the alloy may be heated to one temperature, cooled, heated again to a second temperature and cooled. Examples of these processes are disclosed in U.S. Pat. No. 3,871,928. The temperatures and time periods used to age harden an alloy depend upon the composition of the alloy. For all age-hardenable commercial alloys there are established times and temperatures used that have become standard in the industry because they are known to produce the desired properties. For Ni—Cr—Mo alloys having high chromium content, that is chromium greater than 12% , the general view in the art is that heat treatment beyond the initial annealing in an effort to improve mechanical properties would be impractical due to the lengthy required times (hundreds to thousands of hours) and such treatments simply have not been done.

Solid-solution strengthened nickel-chromium-molybdenum (Ni—Cr—Mo) alloys and nickel-molybdenum (Ni—Mo) alloys are widely utilized for commercial applications in the chemical industry, for example. Generally, considered to be single phase materials, discounting the presence of minor carbide phases, alloys such as these are not usually considered responsive to heat treatment, and are therefore used in the annealed condition. There are exceptions, where some particular alloys do exhibit a commercially exploitable age hardening response. However, in these instances the age-hardening response observed is attributable to other elements, such as niobium, aluminum and titanium being present in the alloy composition. The exception to this is HAYNES® 242™ alloy which will be discussed later. The fact that Ni—Cr—Mo and Ni—Mo alloys are not commercially age-hardenable does not mean that they do not exhibit any metallurgical response to thermal exposure at intermediate temperatures. Actually, alloys of this type can exhibit complex secondary phase reactions when exposed in the temperature range from about 1000° F. to 1600° F. Unfortunately, the phases which form can often be deleterious to both alloy ductility and other aspects of service performance. This is particularly observed with Ni—Mo alloys containing about 25 to 30% molybdenum. In such materials, exposure at temperatures from about 1000° F. to 1600° F. can result in the rapid formation of embrittling $Ni_3Mo$ or $Ni_4Mo$ phases in the microstructure. This can be a problem for both component manufacturing and for component performance.

For lower molybdenum, higher chromium, content Ni—Cr—Mo alloys with about 16% molybdenum and 16% chromium weight percent content, the occurrence of these particular intermetallic phases is not usually observed after short term thermal exposures. With longer term exposure at temperatures from about 1000° F. to 1200° F., there is a distinctly different metallurgical response. After about 500 to 1000 hours the presence of the phase $Ni_2(Mo,Cr)$ is evidenced in the microstructure. A long-range-ordered phase, with structure similar to that of $Pt_2Mo$ , the $Ni_2(Mo,Cr)$ phase serves to significantly increase the strength of these materials without a severe loss of ductility. The one major drawback is the prolonged aging time required to produce this phase.

There are several United States patents that disclose Ni—Cr—Mo alloys. U.S. Pat. No. 4,818,486 discloses a low thermal expansion nickel based alloy that contains 5% to 12% chromium and 10% to 30% molybdenum. The patent teaches that the aging times typically required to obtain desired hardness without deleterious phases being formed is well over 1000 hours at temperatures of 1200° F. to 1500° F. for most Ni—Mo—Cr alloys. However, the aging time to harden the alloy composition disclosed in the '486 patent is as little as 24 hours at 1200° F. The alloy of this patent has been marketed under the trademarks 242 alloy and HAYNES 242 alloy. HAYNES 242 alloy has been sold for applications requiring high tensile strength and a low coefficient of thermal expansion. Other beneficial properties of the 242 alloy include good thermal stability, good low cycle fatigue resistance, and excellent containment capabilities due to its tensile strength and ductility. HAYNES 242 alloy consists of about 8% (weight percent) chromium, about 20–30% molybdenum, about 0.35% to up to about 0.5% aluminum, up to 0.03% carbon, up to about 0.8% manganese, up to about 0.8% silicon, up to about 2% iron, up to about 1% cobalt, up to about 0.006% boron, and the balance weight percent being nickel.

There is a need for a shorter commercially exploitable age hardening process for Ni—Mo—Cr alloys with higher Cr levels (>12% Cr) than found in U.S. Pat. No. 4,818,486 that avoids formation of deleterious $Ni_3Mo$ and $Ni_4Mo$ phase, as well as mu-phase occurrence.

Another Ni—Cr—Mo alloy is disclosed in U.S. Pat. No. 5,019,184 to Crum et al. That alloy contains 19% to 23% chromium and 14 to 17.5% molybdenum. The patent discloses homogenization heat treatment at temperatures ranging from 1149° C. to 1260° C. for periods of from 5 to 50 hours. The purpose of the treatment is to produce a corrosion resistant alloy having a desired microstructure rather than to strengthen the alloy. No tensile strength data is given for any of these samples disclosed in the patent. The alloy of this patent has been commercialized under the designation INCONEL® alloy 686.

Yet another corrosion resistant Ni—Cr—Mo alloy is disclosed in U.S. Pat. No. 4,906,437 to Heubner et al. This alloy contains 22% to 24% chromium and 15% to 16.5% molybdenum. There is no disclosure of any heat treatment or age hardening of this alloy. The alloy disclosed in this patent has been commercialized under the designation VDM NICROFER 923 h Mo or Alloy 59.

A high yield strength Ni—Cr—Mo alloy is disclosed in U.S. Pat. No. 4,129,464 to Matthews et al. This alloy contains 13% to 18% chromium and 13% to 18% molybdenum. The patent says that the alloy could be aged using a single step aging treatment of at least 50 hours at 900° F. to 1100° F., but all examples are aged 168 hours or more. The statement that at least 50 hours is required was an extrapolation of the results obtained from a 168 hours aging treatment. The patent reports data for three alloys numbered 1, 2 and 3. Alloy 1 is commercially available under the trademark HASTELLOY® C-276 alloy. Alloy 2 is commercially available as HASTELLOY C-4 alloy. Alloy 3 is commercially available as HASTELLOY S alloy.

SUMMARY OF THE INVENTION

We provide a single-step age hardening process for certain nickel-chromium-molybdenum alloys containing from 12% to 19% chromium and from 18% to 23% molybdenum that results in higher yield strength, high tensile strength and comparable other mechanical properties as those observed with the current age-hardening process used in the art, such properties being measured by yield strength, tensile strength, and tensile ductility tests at room temperature. This process works only for those alloys in which the other alloying elements are present in amounts so that the composition has a P value that is within the range of 31.2 to 35.9 where P is defined by the equation:

$$P=2.46\ Al+0.19\ Co+0.83\ Cr-0.16\ Cu+0.39\ Fe+0.59\ Mn+1.0\ Mo+0.81\ Zr+2.15\ Si+1.06\ V+0.39\ W+0.68\ Nb+0.52\ Hf+0.45\ Ta+1.35\ Ti$$

The alloys are aged at about 1100° F. to 1225° F. for at least 24 and preferably 48 hours and then air cooled. When so treated the alloys will have tensile properties suitable for use in applications requiring high tensile strength and ductility. By using this relatively short single step aging process high chromium content nickel based alloys having a combination of high yield strength and ductility properties can be made at lower cost than other alloys having such properties. Consequently, the present alloy is a more affordable alloy for applications requiring such properties.

DESCRIPTION OF THE PREFERRED EMBODIMENTS

Figure 1:
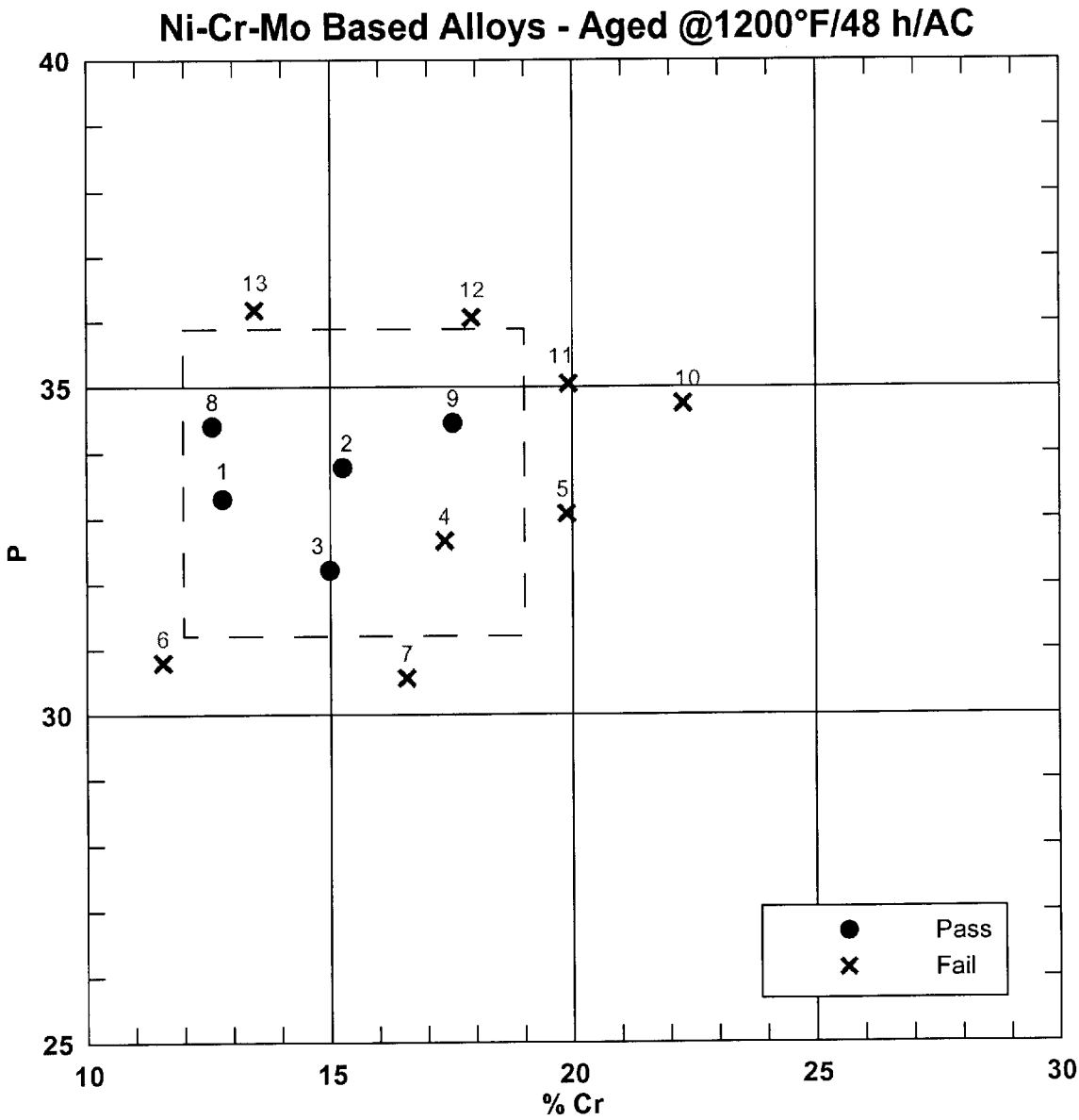
FIG. 1 is a graph of the alloys tested based upon the P value and chromium content of the alloy.

We provide a single-step aging treatment for Ni—Cr—Mo alloys containing from 12% to 19% chromium to produce an alloy for applications requiring corrosion resistance, high tensile strength and excellent tensile ductility. This process involves age hardening the alloy at about 1100° F. to about 1225° F. for at least 24 and then cooling the alloy to room temperature. We have found, however, that this process provides acceptable mechanical properties for only those alloys that contain alloying elements in amounts that provides a P value of from 31.2 to 35.9, P being defined as:

$$P=2.46\ Al+0.19\ Co+0.83\ Cr-0.16\ Cu+0.39\ Fe+0.59\ Mn+1.0\ Mo+0.81\ Zr+2.15\ Si+1.06\ V+0.39\ W+0.68\ Nb+0.52\ Hf+0.45\ Ta+1.35\ Ti$$

We tested 13 nickel base test alloys and 3 Ni—Cr—Mo commercial alloys whose compositions are set forth in Table 1. The commercial alloys were HASTELLOY S sheet, HASTELLOY C-276 sheet, and HASTELLOY C-4 sheet and plate. The thickness of each sheet was 0.125 inches and the plate was 0.375 inches thick. The designation "n.m." in Table 1 indicates that the presence of an element was not measured. Table 1 also reports the P value for each alloy.

The chromium content of the test alloys ranged from 11.56% for alloy 6 to 22.28% for alloy 10. Molybdenum ranged from 14.73% in alloy 10 to 23.89% in alloy 13. All of the alloys contained similar amounts of aluminum, cobalt, iron, and manganese. Tungsten was present within a range of 0.13 to 0.34. The alloys also contained small amounts of boron, carbon, cerium, copper, magnesium, phosphorus, sulfur, silicon, and vanadium. The test alloys were annealed after hot rolling to 0.5" plate at annealing temperatures in the range of 1900° F. to 2000° F. for thirty minutes and water quenched. The commercial alloys were cut from sheets or plate available from the manufacturer. All of the test alloys were treated with a single-step aging treatment in which they were aged at 1200° F. for 48 hours. Then they were air cooled to room temperature. The commercial alloys HASTELLOY S, HASTELLOY C-276 and HASTELLOY C-4 alloys, were aged at 1100° F. for 50 hours. Then they were air cooled to room temperature. This 50 hour treatment corresponds to the treatment proposed for those alloys by Matthews et al. in U.S. Pat. No. 4,129,464.

TABLE 1

| | Composition | | | | | | | | | |
|---|---|---|---|---|---|---|---|---|---|---|
| Alloy | Al | B | C | Ce | Co | Cr | Cu | Fe | Mg | Mn |
| 1 | 0.15 | 0.002 | 0.003 | 0.008 | 0.05 | 12.79 | 0.04 | 1.11 | <0.002 | 0.33 |
| 2 | 0.15 | 0.002 | 0.002 | 0.007 | 0.04 | 15.26 | 0.01 | 1.13 | <0.002 | 0.34 |
| 3 | 0.12 | 0.003 | 0.006 | 0.008 | 0.05 | 14.99 | 0.03 | 1.05 | <0.002 | 0.32 |
| 4 | 0.12 | 0.005 | 0.002 | <0.005 | 0.08 | 17.36 | 0.03 | 1.08 | 0.003 | 0.32 |
| 5 | 0.17 | 0.003 | 0.002 | <0.005 | 0.06 | 19.88 | 0.02 | 1.05 | <0.002 | 0.32 |
| 6 | 0.15 | <0.002 | 0.003 | 0.007 | 0.05 | 11.56 | 0.06 | 1.17 | 0.003 | 0.34 |
| 7 | 0.14 | 0.002 | 0.004 | 0.005 | 0.06 | 16.57 | 0.04 | 1.08 | 0.004 | 0.31 |
| 8 | 0.16 | 0.002 | 0.004 | 0.009 | 0.06 | 12.58 | 0.04 | 1.17 | 0.003 | 0.30 |
| 9 | 0.13 | 0.002 | 0.003 | 0.004 | 0.06 | 17.53 | 0.04 | 1.11 | 0.002 | 0.31 |
| 10 | 0.17 | 0.002 | 0.006 | 0.005 | 0.06 | 22.28 | 0.01 | 1.17 | 0.002 | 0.30 |
| 11 | 0.14 | <0.002 | 0.007 | 0.004 | 0.05 | 19.92 | 0.01 | 0.98 | <0.002 | 0.29 |
| 12 | 0.13 | <0.002 | 0.007 | 0.005 | 0.06 | 17.92 | 0.01 | 1.04 | 0.002 | 0.27 |
| 13 | 0.14 | <0.002 | 0.006 | 0.006 | 0.06 | 13.45 | <0.01 | 1.00 | 0.002 | 0.27 |

TABLE 1-continued

| | | | | | | | | | | |
|---|---|---|---|---|---|---|---|---|---|---|
| Hastelloy S | 0.21 | 0.010 | 0.010 | Ti < 0.01 | 0.05 | 14.92 | <0.01 | 0.42 | 0.01 | 0.55 |
| C-276 | 0.23 | <0.002 | 0.003 | Ti < 0.01 | 1.53 | 15.55 | 0.07 | 5.99 | 0.02 | 0.50 |
| C-4 plate | 0.34 | <0.002 | 0.002 | Ti 0.23 | <0.1 | 15.54 | 0.02 | 1.01 | 0.05 | 0.18 |
| C-4 sheet | 0.34 | <0.002 | 0.003 | Ti 0.21 | <0.1 | 15.57 | 0.03 | 0.84 | 0.02 | 0.18 |

| | Composition | | | | | | | | |
|---|---|---|---|---|---|---|---|---|---|
| Alloy | Mo | Nb | Ni | P (Phos.) | S | Si | V | W | "P value" |
| 1 | 21.58 | n.m. | 63.68 | <0.004 | 0.001 | <0.01 | 0.01 | 0.19 | 33.3 |
| 2 | 19.92 | n.m. | 62.83 | <0.004 | 0.002 | <0.01 | 0.02 | 0.34 | 33.8 |
| 3 | 18.78 | n.m. | 64.55 | 0.002 | 0.001 | 0.01 | <0.01 | 0.15 | 32.2 |
| 4 | 17.21 | n.m. | 63.44 | 0.003 | 0.001 | 0.02 | <0.01 | 0.14 | 32.7 |
| 5 | 15.40 | n.m. | 63.23 | 0.005 | 0.001 | 0.03 | <0.01 | 0.14 | 33.1 |
| 6 | 19.75 | n.m. | 66.37 | <0.004 | 0.001 | 0.15 | 0.02 | 0.15 | 30.8 |
| 7 | 15.60 | n.m. | 65.99 | <0.002 | 0.003 | 0.07 | 0.02 | 0.15 | 30.6 |
| 8 | 22.48 | n.m. | 62.46 | <0.004 | <0.001 | 0.15 | 0.02 | 0.22 | 34.4 |
| 9 | 18.63 | n.m. | 61.84 | <0.004 | 0.003 | 0.11 | 0.02 | 0.15 | 34.5 |
| 10 | 14.73 | n.m. | 61.22 | 0.005 | 0.001 | 0.16 | 0.02 | 0.18 | 34.7 |
| 11 | 17.38 | 0.03 | 60.98 | <0.002 | 0.001 | 0.05 | 0.03 | 0.13 | 35.1 |
| 12 | 20.08 | 0.03 | 60.24 | 0.005 | 0.001 | 0.04 | 0.03 | 0.14 | 36.1 |
| 13 | 23.89 | 0.03 | 61.41 | 0.002 | 0.001 | 0.04 | 0.03 | 0.15 | 36.2 |
| Hastelloy S | 14.48 | n.m. | Bal. | 0.011 | <0.002 | 0.36 | n.m. | <0.1 | 28.7 |
| C-276 | 15.41 | <0.05 | Bal. | 0.007 | 0.001 | 0.04 | 0.15 | 3.98 | 33.6 |
| C-4 plate | 15.41 | <0.05 | Bal. | <0.005 | <0.002 | 0.04 | 0.02 | <0.1 | 30.1 |
| C-4 sheet | 15.24 | n.m. | Bal. | 0.013 | <0.002 | 0.04 | 0.02 | <0.1 | 29.9 |

All of the samples were tested to determine their tensile properties. The tests determined yield strength, ultimate tensile strength, and percent elongation by following the standard ASTM E-8 test procedures for such alloys. The results of those tests are reported in Table 2

TABLE 2

Room Temperature Tensile Properties for Sample Alloys (Aged 1200° F./48 hr/AC)

| Alloy | 0.2% Yield Strength (ksi) | Ultimate Tensile Strength (ksi) | Percent Elongation |
|---|---|---|---|
| 1 | 114.2 | 185.9 | 41.0 |
| 2 | 116.3 | 187.5 | 40.5 |
| 3 | 107.9 | 179.3 | 43.0 |
| 4 | 51.2 | 115.7 | 63.7 |
| 5 | 56.6 | 117.0 | 59.9 |
| 6 | 50.3 | 120.4 | 63.8 |
| 7 | 46.9 | 113.3 | 63.7 |
| 8 | 112.6 | 183.7 | 43.6 |
| 9 | 79.5 | 153.0 | 50.8 |
| 10 | 50.1 | 113.7 | 61.7 |
| 11 | 51.2 | 116.7 | 63.2 |
| 12 | 125.5 | 192.7 | 32.6 |
| 13 | 129.3 | 205.5 | 30.0 |

To be acceptable an alloy must have elongation values greater than 40 percent and yield strengths greater than 73 ksi. Alloys 1, 2, 3, 8 and 9 all had acceptable properties. Alloys 12 and 13 did not possess enough tensile ductility as measured by the percent elongation. Alloys 4, 5, 6, 7, 10 and 11 did not possess a high enough yield strength. Since the chromium content and molybdenum content of alloy 12 is within the range of chromium content and molybdenum content of the acceptable alloys it is clear that neither chromium content nor molybdenum content is the sole predictor of acceptable tensile properties in this class of alloys. We concluded that it is the interaction of nearly all of the alloying elements that is the predictor of such properties. Indeed, we discovered that when the alloy has a P value in the range of 31.2 to 35.9, chromium in the range of 12% to 19% and molybdenum in the range of 18% to 23% were acceptable tensile properties achieved with this aging process.

FIG. 1 is a graph of the tested alloys based upon the P value of the alloy and the chromium content. Each alloy that had acceptable tensile properties is plotted with a dot. An X is used to plot those alloys whose tensile properties were not acceptable after the alloy was subjected to the single step aging treatment. A box has been drawn around the acceptable alloys. It is readily apparent from FIG. 1 that the acceptable alloys have a chromium content of 12% to 19% and a P value within the range of 31.2 to 35.9.

Figure 2:
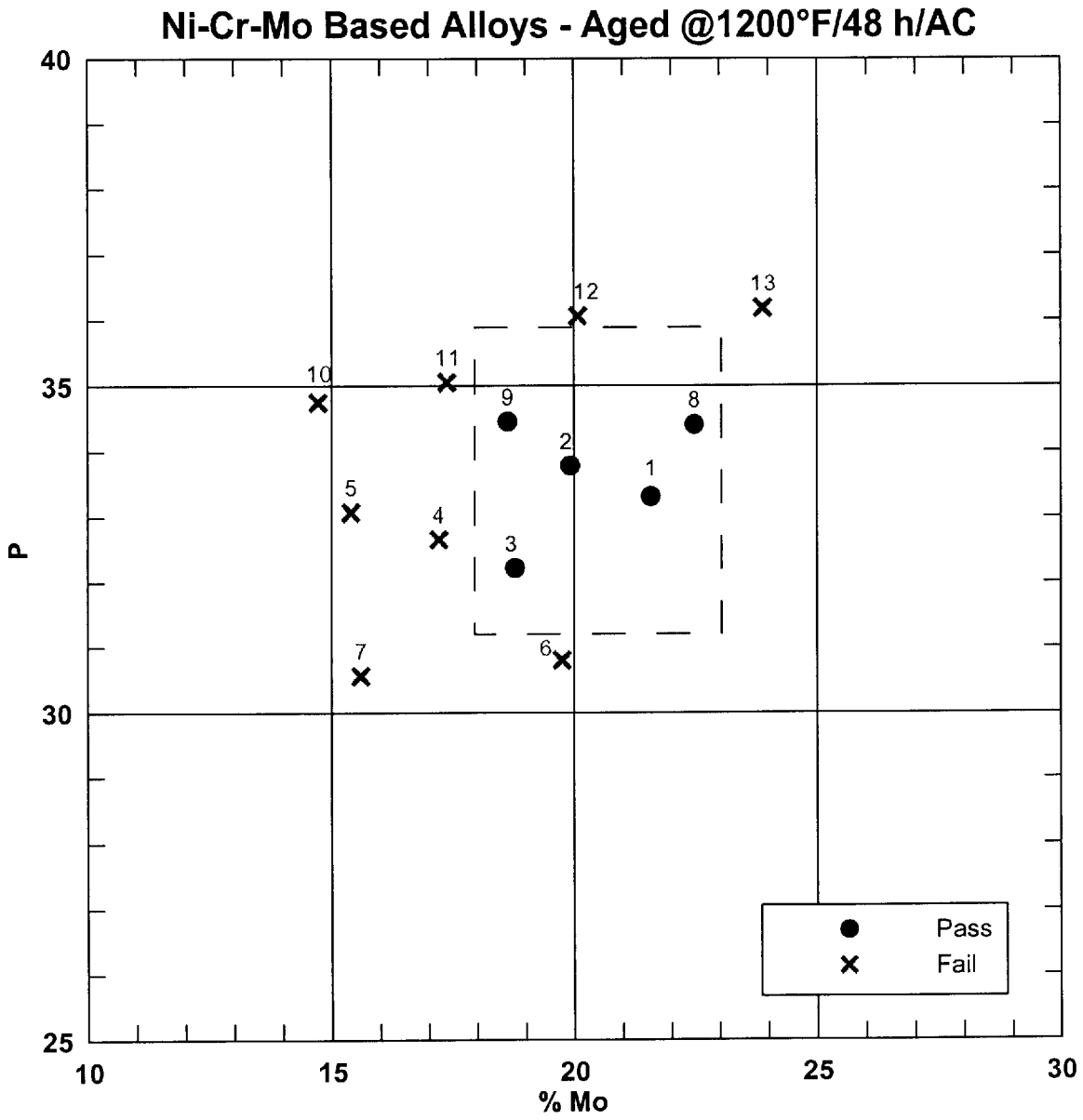
FIG. 2 is a graph of the alloys tested based upon the P value and molybdenum content of the alloy.

FIG. 2 is a graph similar to FIG. 1 but plots the P value of the alloy against the molybdenum content. As shown in FIG. 2, the acceptable alloys contain from 18% to 23% molybdenum. The fact that Alloy 4 did not pass the tensile property requirements even though its chromium content is within the desired range indicates that molybdenum content is also critical. Alloy 4 had only 17% molybdenum.

Having identified the compositions of alloys that could be successfully age-hardened at 1200° F. to 48 hours and air cooled we then looked to see if the alloys disclosed by Matthews et al. in U.S. Pat. No. 4,192,464 would have acceptable properties when treated at 1100° F. for 50 hours. That patent at column 4, lines 4–5 contains a statement that the data obtained and there reported for longer treatments suggests that aging for about 50 hours at 1100° F. will be effective. Test samples were cut from commercially available HASTELLOY S sheet, HASTELLOY C-276 sheet and HASTELLOY C-4 sheet and HASTELLOY C-4 plate. The thickness of the sheets was 0.125 inches and the plate was 0.375 inches thick. The composition of these alloys is in Table 1. These samples were aged at 1100° F. for 50 hours and then air cooled. The aged samples were then tested to determine their tensile strength properties using standard ASTM E8 test procedures. The results of those tensile tests are reported in Table 3.

TABLE 3

Room Temperature Tensile Properties for Commercial Alloys (Aged 1100° F./50 hr/AC)

| Alloy | 0.2% Yield Strength (ksi) | Ultimate Tensile Strength (ksi) | Percent Elongation |
|---|---|---|---|
| Hastelloy S | 66.0 | 133.8 | 46.8 |
| C-276 | 68.5 | 124.5 | 55.2 |
| C-4 plate | 58.1 | 125.5 | 55.2 |
| C-4 sheet | 94.5 | 153.4 | 43.9 |

All of the samples had acceptable tensile strength and elongation. The yield strength of HASTELLOY S sheet, C-276 sheet and C-4 plate samples were below 73 ksi and consequently were unacceptable. The C-4 sheet had acceptable yield strength and unlike the C-4 plate was acceptable. The difference in yield strength between the C-4 sheet and the C-4 plate is likely attributable to some unknown phenomenon, possibly a surface phenomenon, that gives thin specimens higher yield strength than thicker samples. Whatever the reason for the difference, the test data indicates that, contrary to Matthews' suggestion, a 50 hour aging treatment at 1100° F. will not produce acceptable results for all Ni—Cr—Mo alloys. Indeed, it only worked for a thin sample of a single alloy. The present process works for all forms of alloys meeting the chromium, molybdenum and P value specified here. All of the three commercial alloys had less than 18% molybdenum. Furthermore, C-4 alloy and HASTELLOY S alloy had P values below 31.2. As our data demonstrates a single step aging treatment as short as 48 hours provides acceptable tensile properties for all forms of only those Ni—Cr—Mo alloys having 12% to 19% chromium, 18% to 23% molybdenum and a P value of from 31.2 to 35.9.

Those skilled in the art will recognize that while chromium and molybdenum must be present within the ranges encompassed by the test specimens, other alloying elements are not so limited. Indeed, those elements could be present in amounts within the ranges set forth in the UNS descriptions for commercially available Ni—Cr—Mo alloys which include those tested here and alloys such as C-2000® alloy, C-22® alloy, SM 2060 Mo alloy and MAT-21 alloy. More specifically there could be up to 0.5% aluminum, 0.015% boron, 0.02% carbon, 2.5% cobalt, 2.0% copper, 3.0% iron, 1.5% manganese, 1.25% niobium , 0.04% phosphorus, 0.03% sulfur, 0.75% silicon, 2.2% tantalum, 0.7% titanium, 0.35% vanadium and 4.5% tungsten and 0.1% of a rare earth element.

Having now defined the alloys that can benefit from this age hardening process we considered what time and temperature range would be acceptable. A series of aging treatments was given to Alloy 2. After the aging treatments were performed the hardness was measured to determine whether the samples had age hardened. The results are shown in Table 4.

TABLE 4

The Effect of Different Aging Treatments on the Hardness of Alloy 2

| Temp (° F.) | Time (h) | Hardness (Rc) |
|---|---|---|
| Unaged | — | <20.0 |
| 1100 | 48 | 20.6 |
| 1200 | 24 | 31.3 |
| 1200 | 48 | 36.1 |
| 1250 | 48 | <20.0 |
| 1300 | 48 | <20.0 |

A sample was determined to have age hardened if it had a Rockwell C (Rc) hardness value of more than 20.0. A sample in the unaged condition confirmed that the material started out with a hardness of less than 20.0. Samples given aging treatments at 1200° F. for about 24 to 48 hours were found to strongly age harden. The sample aged at 1100° F. for 48 hours just barely hardened while the samples aged at 1250° F. and 1300° F. for 48 hours did not harden. The test results indicate that the alloy should be age hardened for at least about 24 hours at a temperature ranging from about 1100° F. to about 1225° F. Even though the longest aging time used in our tests was 48 hours longer aging times could be used. However, we prefer that the age-hardening treatment here disclosed be done in a total time of less than 100 hours and preferably less than 50 hours. Indeed we prefer to complete the process in 48 hours. By using heat treatments totaling less than 100 hours, and preferably not greater than 50 hours, one can produce lower cost, high chromium, Ni—Cr—Mo alloys that have desirable tensile properties. While the process here disclosed may also work when total aging times exceed 100 hours, the energy costs associated with such treatments make the process less desirable and commercially impractical.

This process represents a significant advancement. Prior to the present invention Ni—Cr—Mo alloys having greater that 12% chromium were not produced in the age hardened condition since the required aging times were considered to be too great. Because of the energy costs associated with such long treatments the estimated cost of a higher chromium, age-hardened alloy was considered too high and no such alloys are in commercial existence. The single-step age-hardening treatment here disclosed will produce lower cost, high chromium, Ni—Cr—Mo alloys that have desirable tensile properties.

Although we have described certain present preferred embodiments of our alloy and method of producing that alloy, it should be distinctly understood that our invention is not limited thereto but may be variously embodied within the scope of the following claims.

We claim:

1. A method for treating an alloy having a composition comprised in weight percent of from 12% to 19% chromium, from 18% to 23% molybdenum, up to about 0.5% aluminum, up to about 0.015% boron, up to 0.02% carbon, up to about 2.5% cobalt, up to about 3% iron, up to about 1.5% manganese, up to about 1.25% niobium, up to about 0.75% silicon, up to about 2.2% tantalum, up to about 0.7% titanium, up to about 4.5% tungsten, and the balance nickel plus impurities, wherein the alloy has a P value of from 31.2 to 35.9, P being defined as:

$$P=2.46\ Al+0.19\ Co+0.83\ Cr-0.16Cu+0.39\ Fe+0.59\ Mn+1.0\ Mo+0.81\ Zr+2.15\ Si+1.06\ V+0.39\ W+0.68\ Nb+0.52\ Hf+0.45\ Ta+1.35\ Ti$$

the method comprised of:

age hardening the alloy at about 1100° F. to about 1225° F. for at least 24 hours; and cooling the alloy to room temperature.

2. The method of claim 1 wherein the alloy is age hardened in not more than 50 hours.

3. The method of claim 1 wherein the alloy is age hardened at about 1200° F. for 48 hours.

4. The method of claim 1 wherein the alloy is in an annealed condition immediately prior to age hardening the alloy.

* * * * *

UNITED STATES PATENT AND TRADEMARK OFFICE

CERTIFICATE OF CORRECTION

PATENT NO. : 6,579,388 B2 
DATED : June 17, 2003
INVENTOR(S) : Lee M. Pike, Jr. and Dwaine L. Klarstrom It is certified that error appears in the above-identified patent and that said Letters Patent is hereby corrected as shown below:

Column 3,
Line 31, in the first term of the equation, change "2.46" to -- 2.64 --.

Column 4,
Line 18, in the first term of the equation, change "2.46" to -- 2.64 --.

Column 9,
Line 7, in the first term of the equation, change "2.46" to -- 2.64 --.

Signed and Sealed this

Fourteenth Day of October, 2003

JAMES E. ROGAN
*Director of the United States Patent and Trademark Office*